US005851053A

United States Patent [19]

Crawford

[11] Patent Number: 5,851,053

[45] Date of Patent: Dec. 22, 1998

[54] HANGING CHAIR

[76] Inventor: David H. Crawford, 5708 Table Top Ct., Boulder, Colo. 80301

[21] Appl. No.: 933,805

[22] Filed: Sep. 19, 1997

[51] Int. Cl.[6] ..... A47D 13/10

[52] U.S. Cl. ..... 297/273; 297/280; 5/123; 5/120

[58] Field of Search ..... 297/273, 277, 297/278, 279, 280, 281; 5/120, 122, 123, 124, 127, 128

[56] References Cited

U.S. PATENT DOCUMENTS

| | | | |
|---|---|---|---|
| 580,076 | 4/1897 | Wohler . | |
| 925,044 | 6/1909 | Shultz . | |
| 4,221,429 | 9/1980 | Wade | 297/277 |
| 4,304,437 | 12/1981 | Longo | 297/277 |
| 4,693,512 | 9/1987 | Hobson | 297/277 |
| 4,825,855 | 5/1989 | Kundson, Jr. | 128/79 |
| 4,838,609 | 6/1989 | Christensen | 297/277 |
| 5,588,702 | 12/1996 | Litwin | 297/277 |
| 5,655,235 | 8/1997 | DeAth | 5/123 |
| 5,673,444 | 10/1997 | Middendorf | 5/120 X |

FOREIGN PATENT DOCUMENTS

| | | | |
|---|---|---|---|
| 1026601 | 4/1953 | France | 297/280 |
| 2186481 | 8/1987 | Germany | 5/120 |

OTHER PUBLICATIONS

Above Ground Designs—The Aerial Chair Advertising Literature, pp. 1–3, date and place of publication are unknown.

Hangouts—Advertising Literature, Copyright 1986, 1992 and 1996, pp. 1–10, date and place of publication are unknown.

Hammocks by Linda—Advertising Literature, 2 pages, date and place of publication are unknown.

Hawaiian Sun Chairs—Advertsing Literature and Setup Instructions, 5 pages, date and place of publication are unknown.

Laid Back Chairs—Advertising Literature, 2 pages, date and place of publication are unknown.

Hanging Sky Chairs—Advertising Literature and Setup Instructions, 7 pages, date and place of publication are unknown.

*Primary Examiner*—Laurie K. Cranmer

*Attorney, Agent, or Firm*—Holme Roberts & Owen LLP

[57] ABSTRACT

The present device is directed to a hanging chair that includes a chair and a suspension structure for connecting the chair to an overhead support. The suspension structure includes a longitudinally extending support member that is operatively attached to the chair and located substantially parallel to the longitudinal axis of the chair. Also included in the suspension structure is a device that permits the user to adjust the angle of chair relative to the ground.

22 Claims, 6 Drawing Sheets

HANGING CHAIR

FIELD OF THE INVENTION

The present invention relates to a hanging chair that is generally comprised of a chair member and a structure for suspending the chair from an overhead support.

BACKGROUND OF THE INVENTION

A hanging chair is comprised of a chair and a suspension structure that connects the chair to an overhead support. In one type of hanging chair, the chair is comprised of a flexible panel that is defined by an upper edge, left edge, right edge and lower edge. The distance between the upper and lower edges is generally adequate for supporting the head, torso and at least a portion of the lower extremities of the typical user. Similarly, the distance between the left and right edge is generally sufficient to support the width of the typical user. The suspension structure includes a laterally extending support member, i.e., a member that extends left to right across the body of a user when the user is in the chair, that is connected to the left and right sides of the flexible panel. Also part of the suspension structure is a rope for connecting the laterally extending support member to the overhead support. The ends of the rope are attached to the ends of the laterally extending support member. A loop at the midpoint of the rope is used to suspend the chair from a hook or similar structure that is anchored into the overhead support. In this particular embodiment, the laterally extending support member is generally of a length that is greater than the lateral or left-right dimension of the typical user. As a consequence, the laterally extending support member prevents the left and right sides of the flexible panel from folding in on the user when the user reclines in the chair.

In another embodiment that employs a flexible panel, the suspension system has been modified so that it also prevents the upper and lower edges of the panel from folding in on the user when the user reclines in the chair. This is accomplished by using two side support members that extend along the sides of the chair. One end of each of the side support members is connected to the upper end of a side and the other end is connected to the lower end of the side, thereby preventing the upper and lower edges of the panel from folding in on the user. The ends of the two side support members are connected to the ends of the laterally extending support member, which is connected to the overhead support as previously described.

A further type of hanging chair employs a chair that is comprised of a rigid peripheral structure, which is generally made of wood or some kind of tubing, and a web that spans the rigid peripheral structure. Typically, ropes or cables are used to attach the rigid peripheral structure to the overhead support.

Yet another type of hanging chair uses a chair in which at least one of the back and seat portions is made of wood, plastic or other relatively rigid material. The lateral sides of the chair member are typically attached to the overhead support member using ropes or chains. An example of this type of chair is the well known porch swing.

SUMMARY OF THE INVENTION

The present invention is directed to a hanging chair that provides the user with the ability to readily adjust the angle of the chair relative to the ground. One embodiment of the invention includes a chair with a back portion for supporting the user's torso and a seat portion for supporting at least a portion of the lower extremities of the user. The chair is also generally symmetrical about a longitudinal axis that divides the back and seat portions into a left lateral side and a right lateral side. When in use, the user's body generally reclines in a direction that is parallel to the longitudinal axis of the chair. A suspension structure is provided that serves both to hang the chair from an overhead support and to provide the user with the ability to readily adjust the angle of the chair relative to the ground. The suspension structure includes a longitudinally extending rod or pole, a first linkage for connecting the chair to the rod, and a second linkage for connecting the rod to the overhead structure. In adjusting the angle of the chair relative to the ground, the first linkage serves to maintain the position of the chair relative to the rod. As a consequence, the angle of the rod relative to the ground substantially determines the angle of the chair relative to the ground. The second linkage provides the ability to easily and quickly adjust the angle of the rod and the angle of the chair relative to the ground. In one embodiment, the second linkage includes a rope whose ends are attached to the ends of the rod and a slip knot that engages a hook or similar structure associated with the overhead support. By adjusting the location of the slip knot, the angle of the rod and chair relative to the ground can be readily adjusted. In another embodiment, the second linkage again uses a rope whose ends are attached to the ends of the rod. However, in this embodiment, a fixed knot is employed and the length of the rope extending between the ends of the rod is adjusted to change the angle of the chair. The length of rope is adjusted by changing the point on the rope at which the rope is attached to one end of the rod. In a third embodiment, the angle of the rod is altered by employing a second linkage that contacts the rod at a single location which can be adjusted. For example, if the second linkage joins the rod at a point that is closer to the back portion of the chair than the seat portion of the chair, the chair will be oriented in a relatively upright position. If the point at which the second linkage joins the rod is then moved more towards the seat portion of the chair, the chair is oriented in a more reclined position.

The present invention also provides for adjustment of the angle of the chair relative to the ground by permitting the distance between the seat portion and the ground to be adjusted. In this adjustment, the length of the linkage between the top of the back portion of the chair and the ground cannot be adjusted. However, the length of the linkage between points lower down on the back portion of the chair or on the seat portion of the chair and the ground can be adjusted. Adjustment of the length of this linkage, in effect, causes the chair to rotate about the top of the back portion of the chair, thereby changing the angle of the chair relative to the ground. Alternatively, a linkage associated with the seat portion of the chair could be of fixed length and the length of the linkage associated with points further up the chair could be adjustable to alter the angle of the chair relative to the ground.

Also provided by the present invention is a combination hanging chair and footrest that employs a less complex suspension structure than known hanging chairs. The chair portion of the invention is comprised of a flexible material. A suspension structure serves to hang the chair from an overhead support and to deploy the flexible material of the chair such that the chair does not collapse in upon the user. The suspension structure includes three rods and a linkage that connects the rods to the chair. The rods serve both to prevent (1) the left and right sides of the chair from collapsing in on the user and (2) the seat and back portions of the chair from collapsing in on the user. In other words, the rods serve to hold the flexible material of the chair open. At least one of the rods extends laterally, i.e. across the user's body when the user is in the chair. This rod is also employed to support the footrest. Know hanging chairs require at least four rods to accommodate a combination hanging chair and footrest.

DETAILED DESCRIPTION

Figure 1:
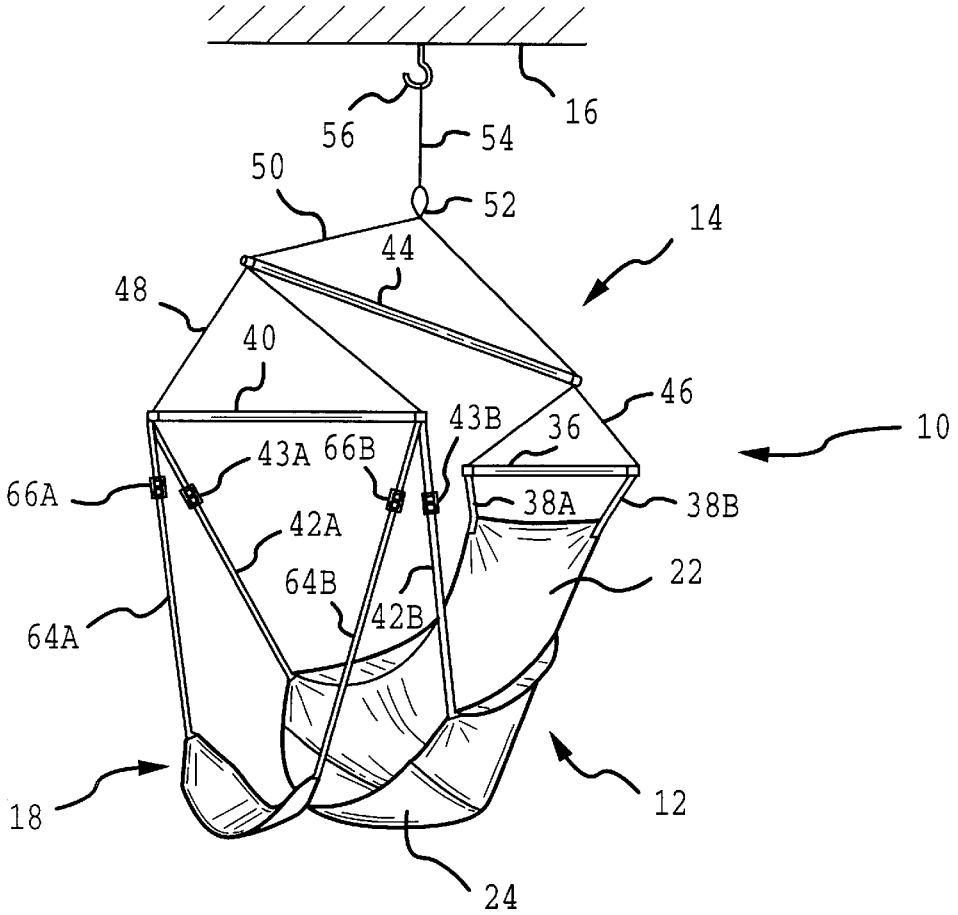
FIG. 1 is a perspective view of the hanging chair of the present invention.

FIG. 1 illustrates an embodiment of a hanging chair 10 of the present invention. Generally, the hanging chair 10 includes a chair 12, a suspension structure 14 for suspending the chair 12 from an overhead support 16, and a footrest 18.

Figure 2:
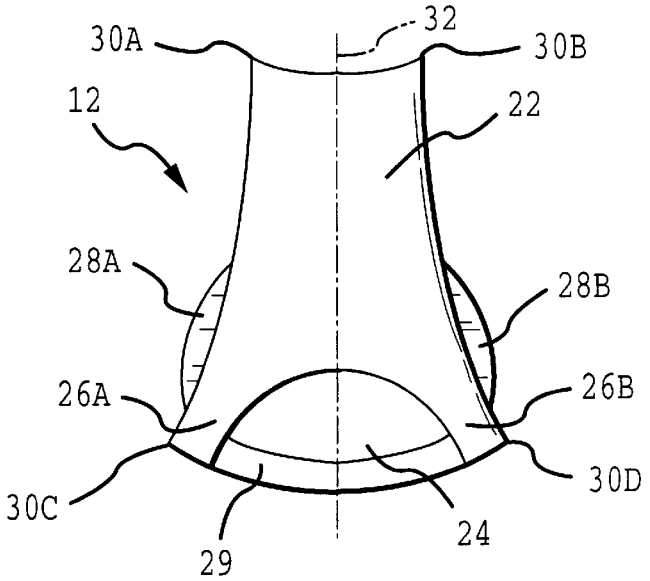
FIG. 2 is a plan view of the chair portion of the hanging chair illustrated in FIG. 1.

With reference to FIG. 2, the chair 12 is comprised of a back portion 22 for supporting the user's back, a seat portion 24 for supporting the lower extremities of the user, and right and left side portions 26A, 26B that cooperate with the back portion 22 and seat portion 24 to form a "bucket" type seat. The chair 12 also includes right and left padded armrests 28A, 28B. A padded seat edge 29 is also provided for the user's comfort. The chair is further defined by four suspension points 30A, 30B, 30C and 30D that are the points of contact between the chair 12 and the suspension structure 14. The four suspension points 30A, 30B, 30C and 30D also roughly define a quadrilateral shape and more specifically a trapezoidal shape. To elaborate, a line drawn between the first and second suspension points 30A, 30B is substantially parallel to, but shorter than a line drawn between the third and fourth suspension points 30C, 30D. Further, a line drawn between the first and third suspension points 30A, 30C is substantially the same length as, but not parallel to a line drawn between the second and fourth suspension points 30B, 30D. It should also be appreciated that the chair 12 is substantially symmetrical about a longitudinal axis 32. In the illustrated embodiment the chair is made of a flexible material, such as canvas, upholstery fabric, tapestry fabric, woven mesh, leather, pack cloth and the like.

The suspension structure 14 includes a back lateral bar 36 that is connected to the first and second suspension points 30A, 30B by back suspension straps 38A, 38B that include webbing cups, which are used throughout the suspension structure 14. Similarly, a seat lateral bar 40 is connected to the third and fourth suspension points 30C, 30D by seat suspension straps 42A, 42B whose lengths can be adjusted by seat buckles 43A, 43B, respectively. Also forming part of the suspension structure 14 is a longitudinal bar 44 that is oriented substantially parallel to and preferable in the same plane as the longitudinal axis 32 of the chair 12. The longitudinal bar 36 is connected to the back lateral bar 36 by a back rope 46 and connected to the seat lateral bar 40 by a seat rope 48. The back lateral bar 36, seat lateral bar 40 and longitudinal bar 44 cooperate to hold the chair, which is made of a flexible material, open so that it does not fold in on the user when the user reclines in the chair 12. To elaborate, the back lateral bar 36 and seat lateral bar 40 prevent the right and left sides of the chair 12 from folding in on the user. Similarly, the longitudinal bar 44 prevents the back portion 22 and seat portion 24 of the chair 12 from collapsing in on a user. The lengths of the back lateral bar 36, seat lateral bar 40 and longitudinal bar 44 are respectively 2, 3 and 4 feet. The bars are made of a hardwood, such as ash. However, other materials can also be used, such as plastic or metal piping.

Also part of the suspension structure 14 is atop rope 50 with ends that are operatively attached to the ends of the longitudinal bar 44. Located intermediate to the ends of the top rope 50 is a slip knot that facilitates altering the angle of the longitudinal bar 44 and the chair 12 relative to the ground. A height adjustment rope 54 and hook 56 complete the suspension structure 12. The height adjustment rope 54 allows the distance between the chair 12 and the ground to be adjusted to suit the user. In some cases, the height adjustment rope 54 may be unnecessary.

Figure 3A:
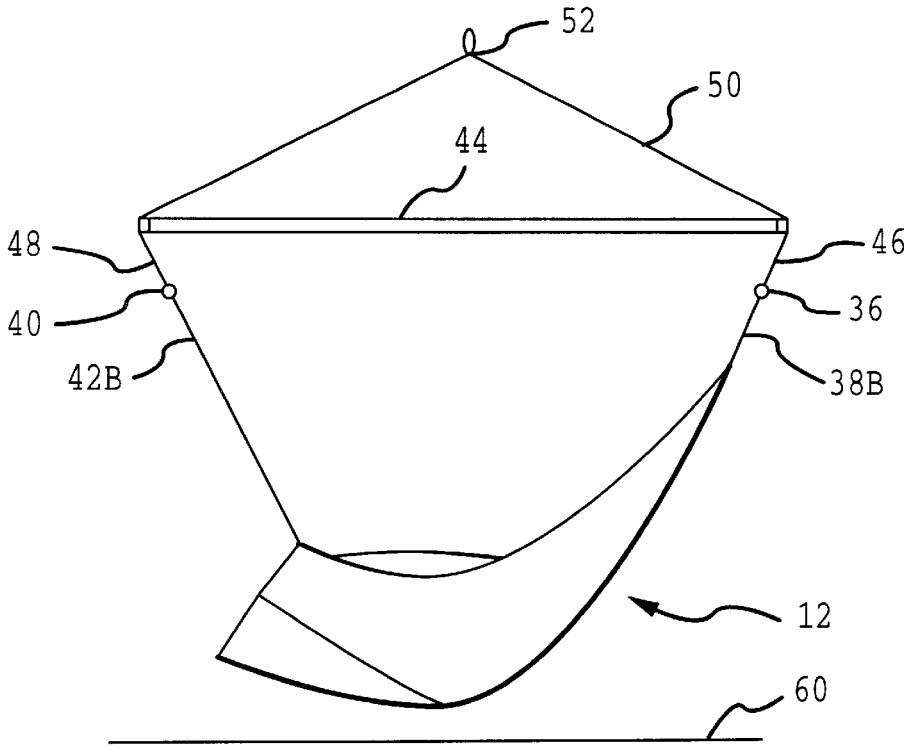
FIGS. 3A and 3B are sides view of the hanging chair that illustrate the use of the longitudinally extending rod in adjusting the angle of the chair relative to the ground.
Figure 3B:
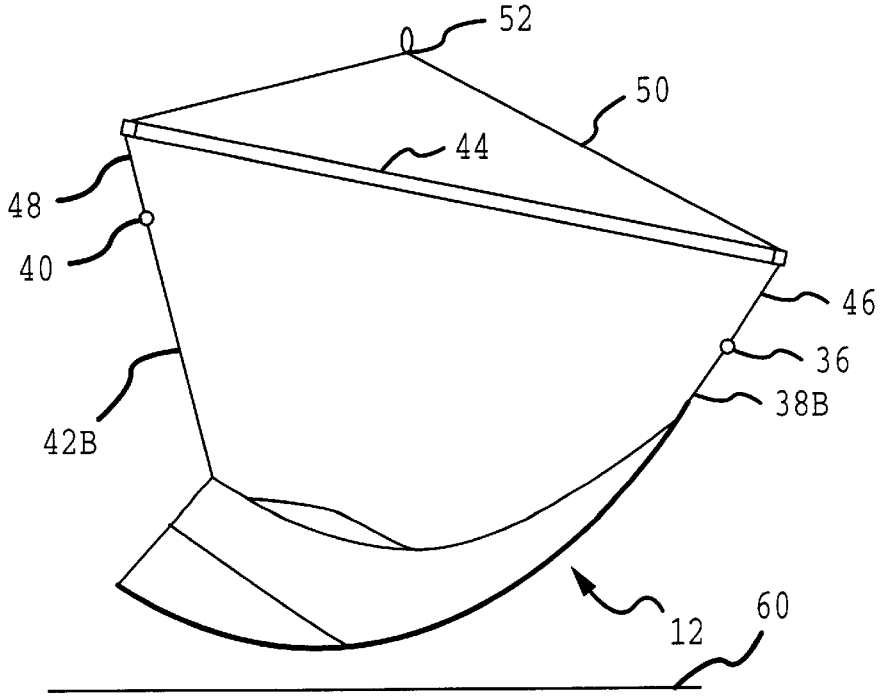

With reference to FIGS. 3A and 3B, adjustment of the reclination angle or angle of the chair relative to the ground is discussed. FIG. 3A illustrates the chair 12 at a first angle relative to the ground and the longitudinal bar 44 substantially parallel to the ground. The angular orientation of the chair 12 and longitudinal bar 44 is determined by the location of the slip knot 52. In this particular case, the slip knot 52 is located substantially midway between the ends of the top rope 50. The components of the suspension structure located between the longitudinal bar 44 and the chair 12 have little effect on the angle of the longitudinal bar 44 and the chair 12 relative to the ground. As a consequence, these components substantially maintain the positional relationship of the chair 12 relative to the longitudinal bar 44.

FIG. 3B illustrates the chair 12 in a more reclined position relative to the chair 12 in FIG. 3A. Also apparent from comparison of FIGS. 3A and 3B is that the longitudinal bar 44 in FIG. 3B is no longer substantially parallel to the ground. The change in the angles of the chair 12 and the longitudinal bar 44 relative to the ground is attributable to a change in the location of the slip knot 52, which is now located more towards the seat portion 24 of the chair 12 than the slip knot 52 of FIG. 3A. From the foregoing, it can be appreciated that the angle of the chair 12 relative to the ground can be easily and quickly adjusted by adjusting the location of the slip knot 52 in the top rope 50. In contrast, the suspension structures of other known hanging chairs requires that two ropes or linkages, one associated with each side of the chair, be adjusted to change the angle of the chair relative to the ground. If the two linkages are not adjusted equally these chairs become skewed. Consequently, time must be taken to adjust two separate structures and to assure that both structures are adjusted equally.

Figure 4A:
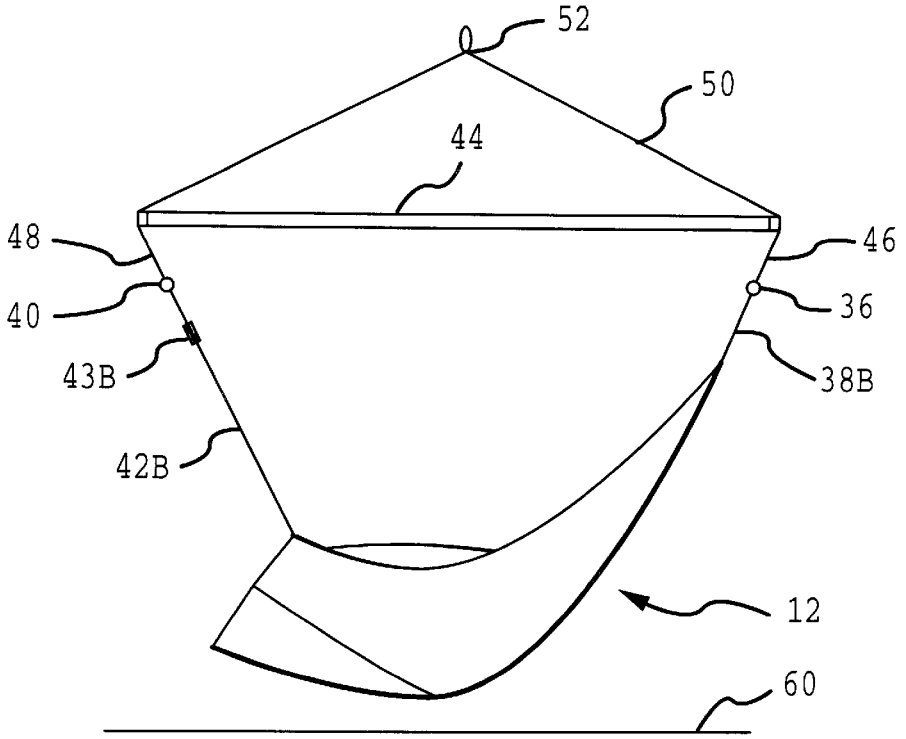
FIGS. 4A and 4B are side views of the hanging chair that illustrate the use of an adjustable linkage to alter the angle of the chair relative to the ground.
Figure 4B:
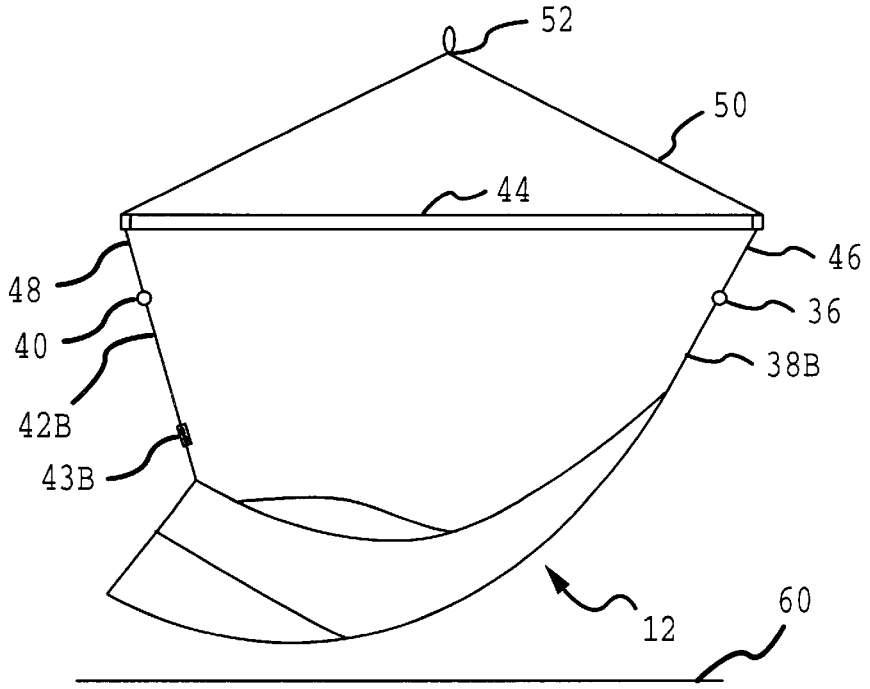

With reference to FIGS. 4A and 4B, a different manner of adjusting the reclination angle of the chair 12 is discussed. This manner of adjusting the angle of reclination involves changing the distance between the seat portion 24 of the chair 12 and the ground 60. In the illustrated embodiment, this adjustment is achieved by changing the lengths of the seat suspension straps 42A, 42B using buckles 43A, 43B. In FIG. 4A, the seat suspension straps 42A, 42B are relatively long. As a consequence, the seat portion 24 of the chair 12 is relatively close to the ground and the chair 12 is in a relatively upright position. FIG. 4B, in contrast, illustrates the use of the buckles 43A, 43B to shorten the length of the seat suspension straps 42A, 42B and thereby place the chair 12 in a more reclined position with the chair 12 positioned further from the ground 60 relative to the chair in FIG. 4A. To facilitate making the seat suspension straps 42A, 42B of equal length, the straps are made from a webbing material that has a colored thread which is exposed at a predetermined interval, such as once every inch.

The padded footrest 18 is connected to the seat lateral bar 40 by footrest suspension straps 64A, 64B. The position of the footrest 18 is adjusted by changing the length of the footrest suspension straps 64A, 64B using footrest buckles 66A, 66B. To assure that both of the footrest suspension straps 64A, 64B are of equal length, the straps are marked at a predetermined interval, as with the seat suspension straps 42A, 42B.

Figure 5A:
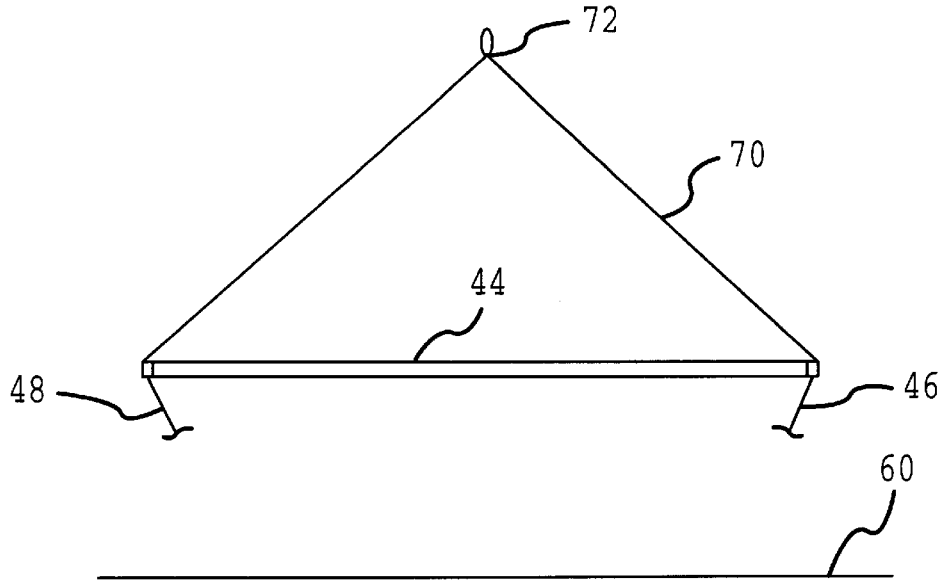
FIGS. 5A and 5B illustrate an alternative structure for adjusting the angle of the chair relative to the ground.
Figure 5B:
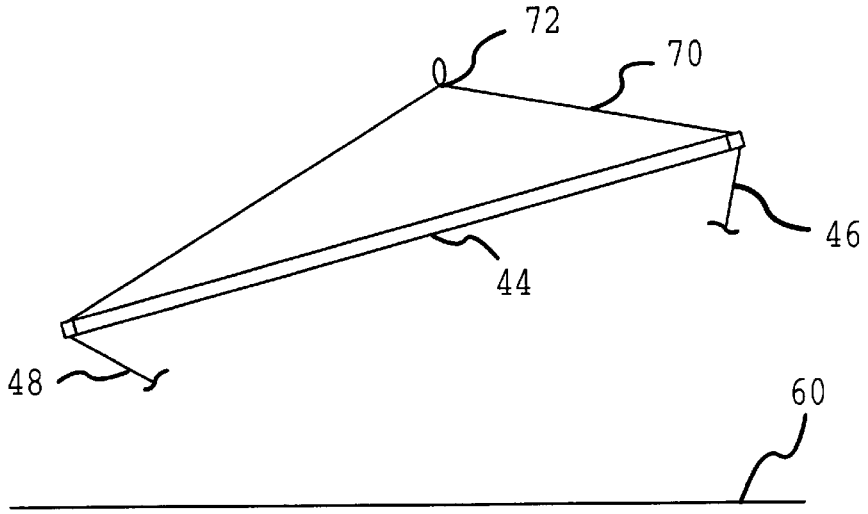

With reference to FIGS. 5A and 5B, a different linkage for adjusting the angle of the longitudinal rod 44 and the chair 12 is discussed. In this case, a length adjustable top rope 70 is provided with a fixed knot 72 located between the ends of the rope. As shown in FIG. 5A, the fixed knot 72 is located substantially midway between the points of the rope that are connected to the ends of the longitudinal bar 44. As a consequence, the longitudinal bar 44 is oriented substantially parallel to the ground 50. The chair 12 has an orientation relative to the ground that is dependent upon the linkage between the longitudinal rod 44 and the chair 12. By changing the point at which one end of the rope 70 is attached to the end of the longitudinal rod, the length of the rope 72 between the ends of the longitudinal rod 44 is changed. Changing the length of the rope 70 causes the fixed knot 72 to be moved more towards the back portion 22 of the chair 12. Moving the fixed knot 72, in turn, changes the angle of the longitudinal bar 44 and the chair 12 relative to the ground 60. It is also possible to change the point at which the other end of the rope 70 attaches to the other end of the longitudinal rod 44 to affect the angle of the longitudinal rod 44 and chair 12 relative to the ground 60.

Figure 6A:
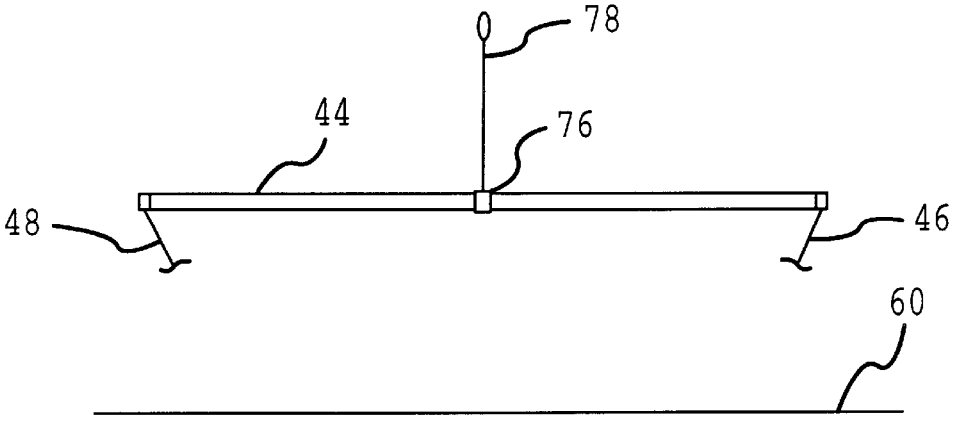
FIGS. 6A and 6B illustrate another alternative structure for adjusting the angle of the chair relative to the ground.
Figure 6B:
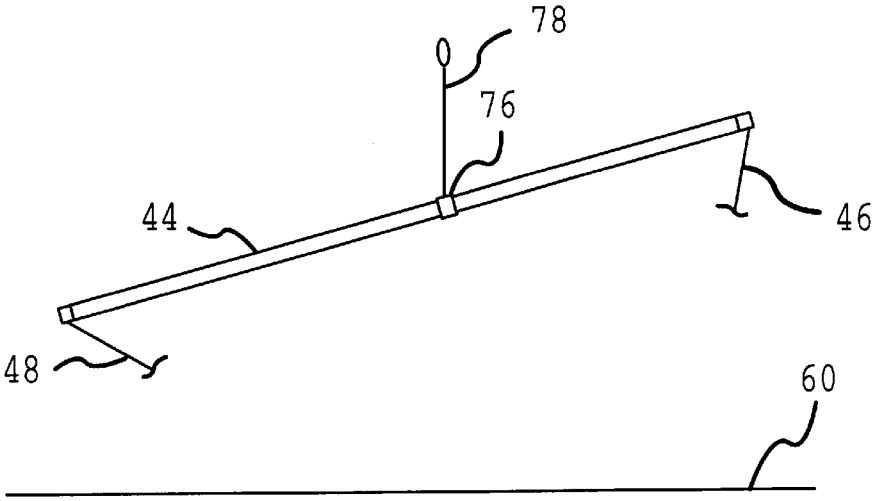

With reference to FIGS. 6A and 6B, a further structure for changing the angle of the longitudinal bar 44 and chair 12 is discussed. This particular linkage includes a fixture 76 that can be fixed in place at any point along the length of the longitudinal bar 44. A linkage 78 that can swivel or rotate with respect to the fixture 76 provides at least part of the connection between the fixture 76 and the overhead support 16. In FIG. 6, the fixture 76 is located substantially midway between the ends of the longitudinal bar 44 and the longitudinal bar 44 is positioned substantially parallel to the ground 60. This, in turn, places the chair 12 in a particular orientation. As shown in FIG. 6B, the position of the fixture 76 has been changed relative to the position shown in FIG. 6A. As a consequence, the angle of the longitudinal bar 44 relative to the ground 60 has been changed. This, in turn, has changed the angle of the chair 12 relative to the ground as previously discussed.

Figure 7:
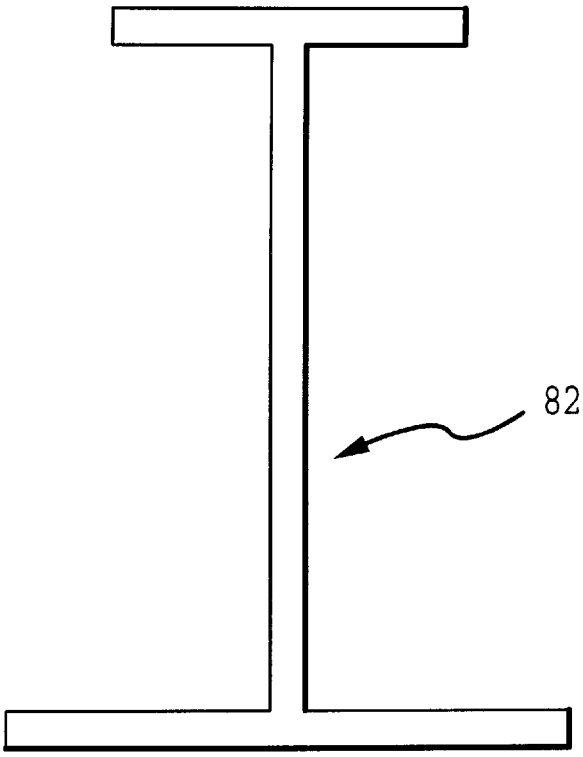
FIG. 7 illustrates an alternative suspension structure that utilizes an I-shaped frame.

With reference to FIG. 7, a single piece bar 82 for use in the suspension structure 14 is illustrated. The unitized bar 82 combines the back lateral bar 36, seat lateral bar 40 and longitudinal bar 44 associated with the suspension structure discussed with respect to FIG. 1 into a monolithic unit that avoids the need for the back rope 46 and seat rope 48. The unitized bar 48 can be constructed in from conventional piping materials or by other methods known in the art.

The adjustment of the angle of the chair 12 via adjustment to the angle of the longitudinal bar 44 is applicable to other types of chairs from that disclosed with respect to FIG. 1. For instance, the adjustment of the angle of the chair disclosed hereinabove can be applied to chairs that have a rigid peripheral framework that is spanned by a flexible web.

The structure for adjusting the reclining angle of a chair can also be applied to chairs that use a panel of relatively rigid material, such as wood, to realize the back and/or seat portion of 10 the chair. If a chair structure is utilized in which at least a portion of the periphery or outer edges of the back or seat portions is rigid, as with either of the two noted types of chairs, the suspension structure is susceptible to modifications that eliminate either or both of the lateral bars but retain the longitudinal bar 44 and associated structure for adjusting the angle of the longitudinal bar 44. For example, if a chair is utilized in which the back and seat portions are made from panels of wood and connected to one another so that their positions with respect to one another are fixed, the lateral bars are no longer needed to hold the chair in an open position. As a consequence, linkages between the chair and the longitudinal bar 44 that do not incorporate the lateral bars are feasible. The structure for adjusting the reclining angle of a chair can also be applied to chairs of different shapes. For instance, the structure can be applied to oval, round, and rectangular chair shapes, as well as many other chair shapes.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiment described hereinabove is further intended to explain the best mode known of practicing the invention and to enable others skilled in the art to utilize the invention in various embodiments and with the various modifications required by their particular applications or uses of the invention. It is intended that the appended claims be construed to include alternate embodiments to the extent permitted by the prior art.

What is claimed is:

1. A hanging chair for suspending from an overhead support comprising:

a flexible panel having an edge and first, second, third and fourth attachment points;

wherein said first and second attachment points are separated by a first distance;

wherein said third and fourth attachment points are separated by a second distance;

wherein said first and third attachment points are separated by a third distance;

wherein said second and fourth attachment points are separated by a fourth distance that is substantially equal to said third distance;

wherein both said third and fourth distances are greater than both said first and second distances;

wherein said flexible panel has a longitudinal line that extends through a first longitudinal point located substantially midway between said first and second attachment points and a second longitudinal point located substantially midway between said third and fourth attachment points;

wherein said flexible panel includes a back portion that extends from said first and second attachment points towards said third and fourth attachment points;

wherein said flexible panel includes a seat portion that extends from said third and fourth attachment points towards said first and second attachment points;

wherein said back portion is of a sufficient length to support the torso of a user;

wherein said seat portion is of a sufficient length, when a user is seated normally and the user's legs are parallel to one another, to support the thighs of the user but not the feet of the user;

wherein said longitudinal line, when said flexible panel is suspended from the overhead support, defines a first plane that is perpendicular to the ground;

wherein said back portion, when said flexible panel is suspended from the overhead support, lies roughly in a second plane that is perpendicular to said first plane;

wherein said seat portion, when said flexible panel is suspended from the overhead support, lies roughly in a third plane that is perpendicular to said first plane;

wherein an angle between said second and third planes along said longitudinal line is less than 180 degrees;

wherein, when a user is seated normally and the user's legs are parallel to one another, the user's feet extend past a portion of said edge that is located between said third and fourth attachment points and can hang freely;

a longitudinal support member for use in suspending said flexible member above the ground;

wherein said longitudinal support member, when said flexible panel is suspended from the overhead support, is separated from the ground;

wherein said longitudinal support member, when said flexible panel is suspended from the overhead support, lies substantially in said first plane defined by said longitudinal line of said flexible member;

first means for connecting said first, second, third and fourth attachment points of said flexible panel to said longitudinal support member;

wherein said first means, when said flexible panel is suspended from the overhead support, is separated from the ground; and a second means for attaching said longitudinal support member to the overhead support;

wherein said second means, when said flexible panel is suspended form the overhead support, is separated from the ground;

wherein said longitudinal support member, first means and second means, when said flexible panel is suspended from an overhead support, collectively bear substantially all of the weight of the user;

wherein said second means includes means for adjusting the angle of both said longitudinal support member and said flexible panel member relative to the ground so that a user can recline in the chair at a desired angle.

2. A hanging chair, as claimed in claim 1, wherein:

said second means includes a slip knot.

3. A hanging chair, as claimed in claim 1, wherein:

said second means includes a linkage extending between ends of said longitudinal support member, wherein the length of said linkage is adjustable.

4. A hanging chair, as claimed in claim 1, wherein:

said first means includes means for adjusting the distance between said third and fourth attachment points of said flexible panel and said longitudinal support member.

5. A hanging chair, as claimed in claim 1, wherein:

said first means includes a lateral member that extends substantially perpendicular to said first plane defined by said longitudinal line of said flexible panel.

6. A hanging chair, as claimed in claim 5, wherein:

said first lateral member is located between said longitudinal support member and said flexible panel.

7. A hanging chair, as claimed in claim 1, wherein:

said first means includes first and second lateral members both of which are located substantially perpendicular to said first plane defined by said longitudinal line of said flexible panel.

8. A hanging chair, as claimed in claim 7, wherein:

said first and second lateral members are both located between said longitudinal support member and said flexible panel.

9. A hanging chair, as claimed in claim 7, wherein:

said first and second lateral members have different lengths.

10. A hanging chair, as claimed in claim 7, wherein:

said longitudinal member is longer than both said first and second lateral members.

11. A hanging chair, as claimed in claim 1, wherein:

said flexible panel includes a first padded armrest that is located between said first and third attachment points of said flexible panel, and a second padded armrest that is located between said second and fourth attachment points of said flexible panel.

12. A hanging chair, as claimed in claim 1, wherein:

said flexible panel includes a padded leg rest that is located between said third and fourth attachment points of said flexible panel.

13. A hanging chair, as claimed in claim 1, wherein:

said flexible panel has a trapezoidal shape such that said first distance is less than said second distance and a line between said first and second attachment points is substantially parallel to a line between said third and fourth attachment points.

14. A hanging chair, as claimed in claim 1, wherein:

said longitudinal member is substantially symmetrical about said longitudinal line.

15. A hanging chair, as claimed in claim 1, further comprising:

a foot rest that is operatively attached to said longitudinal support member.

16. A hanging chair comprising:

a flexible panel having first, second, third and fourth attachment points;

wherein said first and second attachment points are separated by a first distance;

wherein said third and fourth attachment points are separated by a second distance;

wherein said first and third attachment points are separated by a third distance;

wherein said second and fourth attachment points are separated by a fourth distance that is substantially equal to said third distance;

wherein both said third and fourth distances are greater than both said first and second distances;

wherein said flexible panel has a longitudinal line that extends through a first longitudinal point located substantially midway between said first and second attachment points and a second longitudinal point located substantially between said third and fourth attachment points;

a longitudinal support member that lies in a plane containing said longitudinal line of said flexible member;

first means for connecting said first, second, third and fourth attachment points of said flexible panel to said longitudinal support member; and a second means for attaching said longitudinal support member to an overhead beam;

wherein said second means includes means for adjusting the angle of said longitudinal support member and said flexible panel member relative to the ground so that a user can recline in the chair at a desired angle;

wherein said second means includes connector means that can selectively be fixed in place at a number of locations on said longitudinal support member and swivel means that is operatively connected to said connector means.

17. A hanging chair comprising:

a chair member having an edge, a seat portion for supporting the lower extremities of a user when the user is seated normally and the user's legs are parallel to one another, and a back portion for supporting the back of a user;

said chair member having a bisecting line that divides both said seat portion and said back portion into substantially equal halves;

wherein said bisecting line, when said chair member is suspended from an overhead support, defines a first plane that is perpendicular to the ground;

wherein said seat portion, when said chair member is suspended from an overhead support, lies roughly in a second plane that is perpendicular to said first plane;

wherein said back portion, when said chair member is suspended from an overhead support, lies roughly in a third plane that is perpendicular to said first plane;

wherein an angle between said second and third planes along said bisecting line is less than 180 degrees;

a support member, that when the chair is suspended from an overhead support, has at least two locations which lie substantially in said first plane defined by said bisecting line of said chair member;

first means for attaching said edge of said chair member to said support member;

wherein said first means, when said chair member is suspended from an overhead support, is separated from the ground; and second means for attaching said support member to an overhead support;

wherein said second means, when said chair member is suspended from an overhead support, is separated from the ground;

wherein said support member, first means and second means, when said chair member is suspended from an overhead support, collectively bear substantially all of the weight of the user;

wherein said second means includes means for adjusting the angle of said chair member relative to the ground.

18. A hanging chair, as claimed in claim 17, wherein:

said first means includes means for adjusting the distance between at least one point on said edge of said seat member and said longitudinal support member.

19. A hanging chair comprising:

a flexible panel having an edge and first, second, third and fourth attachment points;

wherein said first and second attachment points are separated by a first distance;

wherein said third and fourth attachment points are separated by a second distance that is greater than said first distance;

wherein said first and third attachment points are separated by a third distance;

wherein said second and fourth attachment points are separated by a fourth distance that is substantially equal to said third distance;

wherein both said third and fourth distances are greater than both said first and second distances;

wherein said flexible panel has a trapezoidal shape such that a line between said first and second attachment points is substantially parallel to a line between said third and fourth attachment points;

said flexible panel having a longitudinal line that extends through a first longitudinal point located midway between said first and second attachment points and a second longitudinal point located substantially midway between said third and fourth attachment points;

wherein said flexible panel includes a back portion that extends from said first and second attachment points towards said third and fourth attachment points;

wherein said flexible panel includes a seat portion that extends from said third and fourth attachment points towards said first and second attachment points;

wherein said back portion is of a sufficient length to support the torso of a user;

wherein said seat portion is of a sufficient length, when a user is seated normally and the user's legs are parallel to one another, to support the thighs of the user but not the feet of the user;

wherein said longitudinal line, when said flexible panel is suspended from the overhead support, defines a first plane that is perpendicular to the ground;

wherein said back portion, when said flexible panel is suspended from the overhead support, lies roughly in a second plane that is perpendicular to said first plane;

wherein said seat portion, when said flexible panel is suspended from the overhead support, lies roughly in a third plane that is perpendicular to said first plane;

wherein an angle between said second and third planes along said longitudinal line is less than 180 degrees;

wherein, when a user is seated normally and the user's legs are parallel to one another, the user's feet extend past a portion of said edge that is located between said third and fourth attachment points and can hang freely;

a longitudinal support member that for use in suspending said flexible member above the ground;

wherein said longitudinal support member, when said flexible panel is suspended from the overhead support, is separated from the ground;

wherein said longitudinal support member, when said flexible panel is suspended from an overhead support, lies substantially in said first plane defined by said longitudinal line of said flexible member;

wherein said longitudinal support member has a length of approximately 4 feet;

a first lateral support member for use in suspending said flexible panel above the ground;

wherein said first lateral member when said flexible panel is suspended from an overhead support, is separated from the ground and located between said flexible panel and said longitudinal support member;

wherein said first lateral member, when said flexible panel is suspended form an overhead support, lies substantially perpendicular to said first plane defined by said longitudinal line of said flexible panel;

wherein said first lateral member has a length of approximately 2 feet;

a second lateral support member for use in suspending said flexible panel above the ground;

wherein said second lateral member, when said flexible panel is suspended from an overhead support, is separated from the ground and located between said flexible panel and said longitudinal support member;

wherein said second lateral member, when said flexible panel is suspended form an overhead support, lies substantially perpendicular to said first plane defined by said longitudinal line of said flexible panel;

wherein said second lateral member has a length of approximately 3 feet;

first means for attaching said first lateral support member and said second lateral support member to said longitudinal support member;

wherein said first means, when said flexible panel is suspended form an overhead support, is separated from the ground;

second means for attaching said longitudinal support member to an overhead support;

wherein said second means, when said flexible panel is suspended from an overhead support, is separated from the ground;

wherein said longitudinal support member, first lateral support, second lateral support, first means and second means, when said flexible panel is suspended from an overhead support, collectively bear substantially all of the weight of the user;

wherein said second means for attaching includes means for adjusting both the angle of said longitudinal support member and said flexible panel relative to the ground so that a user can recline in the chair at a desired angle.

20. A hanging chair comprising:

a chair member having a back portion for supporting the torso of a user and a seat portion for supporting, when a user is seated normally and the user's legs extend substantially parallel to one another, the thighs of the user but not the feet of the user;

wherein said chair member has a bisecting line that divides both said seat portion and said back portion into substantially equal halves;

wherein said bisecting line, when said chair member is suspended from an overhead support, defines a first plane that is perpendicular to the ground;

a footrest that is separate from said chair member and used to support the feet of the user;

suspension means for connecting both said chair member and said footrest to an overhead support;

wherein said suspension means includes three rods, a first rod, a second rod and a third rod, but the suspension means does not include a fourth rod;

wherein, when said chair member is suspended from an overhead support, one of said first, second and third rods lies substantially in said plane defined by said bisecting line.

21. A hanging chair as claimed in claim 20, wherein:

said first, second and third rods are connected to one another to form a unitary structure.

22. A hanging chair, as claimed in claim 20, wherein:

at least one of said first, second and third rods extends linearly from said first terminal end to said second terminal end.

* * * * *